United States Patent [19]

Hutzenlaub et al.

[11] Patent Number: 4,550,882

[45] Date of Patent: Nov. 5, 1985

[54] REEL CUTTING AND WINDING MACHINE

[75] Inventors: Armin S. P. Hutzenlaub; Dieter Düppengiesser, both of Wiehl, Fed. Rep. of Germany

[73] Assignee: Erwin Kampf GmbH & Co. Maschinenfabrik, Fed. Rep. of Germany

[21] Appl. No.: 586,964

[22] Filed: Mar. 7, 1984

[30] Foreign Application Priority Data

Mar. 8, 1983 [DE] Fed. Rep. of Germany ..... 3308059

[51] Int. Cl.[4] ..... B65H 35/04

[52] U.S. Cl. ..... 242/56.6; 242/67.5

[58] Field of Search ..... 242/56.2–56.7, 242/57, 67.5, 74; 156/505, 506, 522

[56] References Cited

U.S. PATENT DOCUMENTS 4,160,529 7/1979 Hutzenlaub et al. ..... 242/56.6

OTHER PUBLICATIONS

Papier & Kunstorff Verarbeiter, p. 75, issue of Sep. 1975.

*Primary Examiner*—Leonard D. Christian

*Attorney, Agent, or Firm*—Schwartz, Jeffery, Schwaab, Mack, Blumenthal & Evans

[57] ABSTRACT

A reel cutting and winding machine for longitudinally cutting a sheet into strips and for winding up the strips on winding cores into separate wound packages. Stationary mounting plates are mounted at either side of the machine, and a cross-member is pivotally mounted between the plates. The cross-member is pivotable into a winding position, a wound package sealing position, and a package depositing position. Lever means is operatively connected to the cross-member and carries the winding core. Carrier levers are pivotably mounted between said plates for movement between a waiting position during the winding process and a second, operating position for cutting the sheets transversely when a roll formation is complete. Adjusting levers are pivotably mounted on said carrier levers means and are adjustable independently of said carrier lever means. A vacuum table is carried by the adjusting levers, with the vacuum table holding by suction the strips while being cut and prior to mounting the leading end of said cut strip onto another winding core. A sealant is automatically applied to the end of the strip in the region of the cut so as to close the package and permit the leading end of the next strip to be adhered to the new winding core.

12 Claims, 4 Drawing Figures

REEL CUTTING AND WINDING MACHINE

BACKGROUND OF THE INVENTION

The invention relates to a reel cutting and winding machine for cutting a sheet longitudinally into strips and for winding up the strips into two groups of wound packages, with the separated strips passing over a separating roller and deflector roller. A pivotable cross-member accommodates winding cores in each case on double lever arms and can be adjusted in dependence upon the increasing diameter of the wound package, with pressure rollers being suspended so that they can be pressed on the strip in an individually swinging manner.

Reel cutting and winding machines of this type are used to produce wound packages of high-quality material. The machine is stopped in each case to change the reels. The end of the sheet then has to be cut off and connected by adhesion to the finished wound package. When the finished wound package has been removed from the winding shaft the beginning of the sheet has to be placed on an empty winding core.

SUMMARY OF THE INVENTION

It is the object of the invention to construct a reel cutting and winding machine in such a way that these operating steps can take place as rapidly and as free from disturbances as possible. The completely wound-up reels are to be sealed by means of adhesive labels, the beginnings of the longitudinally cut sheets located in the machine are to be retained and connected by adhesion to an empty winding core by means of further adhesive labels. The process should be fully automatic. The normal winding operation should not be impaired by the transverse cutting apparatus and the joining apparatus.

In accordance with the invention this object is achieved by the following features:

(a) a cross-member is pivotable into a winding position, a wound package sealing position and a depositing position;

(b) a vacuum table is pivotaly mounted on hinged arms;

(c) each hinged arm comprises a carrier lever which is at least pivotable into a waiting position and an operating position;

(d) at the end of the carrier lever each hinged arm has an adjusting lever, at the end of which the vacuum table is retained and which can be pivoted towards two stops for the vacuum table.

As a result of this arrangement the vacuum table is accommodated in the waiting position between the pressure roller and the pivot axis of the pressure roller. Thus the formation of the wound package is not hindered. When the wound packages are changed the strips are severed in a transverse cutting position. The strip end is connected by adhesion to the wound package and the wound package is sealed thereby. The hinged arms from a carrier lever and an adjusting lever enable an adjustment to be made such that the vacuum table, after transverse cutting, can be pivoted out of a transverse cutting position into a joining position, the strip beginning which adheres to the vacuum chamber being entrained without tension. After the reels have been changed the cross-member is pivoted with the empty winding cores into the winding position, the strip beginning in each case being joined onto an empty winding core. When the cross-member is pivoted for the joining process the winding core strikes against the transverse cutting table and movement continues beyond the winding position. Thus the flexibility of the adjusting mechanisms is such that a reliable abutment is ensured.

In a further development of the invention it is provided that the axis of the carrier levers is arranged approximately between the axis of the swinging arms of the pressure roller and the winding axis of the winding core in the winding position. As a result of this a waiting position is provided which does not impair the formation of wound packages.

The invention further provides that in the waiting position of the carrier levers the pivot axis of the adjusting levers is approximately covered by the axis of rotation of the pressure roller and the vacuum table lies externally of the diameter of the wound package. As a result of this it is readily possible to retain the vacuum table in the waiting position externally of the peripheral arc of the wound package by setting the adjusting lever approximately tangentially to the winding core.

The invention further provides that in the transverse cutting and joining position the pivot axis of the adjusting lever lies somewhat externally of the peripheral face of the pressure roller, the distance of the edge of the holder plate along the tangent in the transverse cutting position being equal to the distance of the edge of the holder plate along the corresponding peripheral arc plus the tangent section in the joining position. As a result of this it is ensured that when the vacuum table is pivoted out of the transverse cutting position into the joining position the beginning of the strip is entrained without tension. The sheet length of the beginning of the strip in the case of the tangential path into the transverse cutting position is equal to the sheet length on the peripheral arc of the pressure roller so the corresponding tangent section in the joining position.

The invention further provides that the pivot path of the vacuum table between the joining position and the transverse cutting position is approximately 90°. As a result of this a satisfactory entrainment of the strip beginning and a reliable joining function are ensured.

The invention further provides that in the transverse cutting position the adjusting levers are aligned approximately perpendicularly to the pivot lever of the pressure roller and that a transverse cutting apparatus can be pivoted towards the vacuum table. The strip path in the transverse cutting position enables the transverse cutting apparatus, which is likewise pivoted through approximately 90°, to be pivoted in an advantageous manner.

The invention further provides that in the joining position of the vacuum table the adjusting levers are aligned approximately parallel to the pivot levers of the pressure roller and that the pivot lever of the double lever is approximately perpendicular to the adjusting levers. As a result of this it is ensured that when they pivot towards the pressure roller the winding cores come into contact with the edge of the holder plate of the vacuum table, such that the beginning of the strip is joined onto the winding core and is adhered by means of the adhesive labels applied beforehand.

In order to guarantee the joining process it is further provided that the support of the carrier levers is flexible and that, in the joining position, the empty winding cores, after contacting the swinging rollers, touch the edge of the holder plate of the vacuum table and urge the latter back, the beginning of the sheet of material being taken over. This flexible construction of the joining apparatus in the joining position ensures that the beginning of the strip is applied reliably. The application process can be assisted by an additional application apparatus.

In order that the strip beginning can be applied smoothly onto the winding core, the invention provides that the vacuum table comprises a mechanical or pneumatic joining apparatus which acts in the joining position so as to apply the strip beginning onto the winding core.

In order that the strip end and the strip beginning can be connected reliably by adhesion it is provided that a pivotable label dispenser, which is actuatably coupled to the machine control, is opposite the periphery of the pressure roller.

Finally, the invention proposes that a resetting position is provided for the carrier levers and the vacuum table, in which position the carrier levers and the vacuum table are moved out of the resetting path of the pressure rollers. As a result of this it is ensured that the vacuum table can be pivoted completely out of the adjustment path of the pressure roller.

BRIEF DESCRIPTION OF THE APPLICATION DRAWINGS

One embodiment of the invention is explained in the following with reference to the attached drawings, in which.

DETAILED DESCRIPTION OF THE PREFERRED EMBODIMENT

Figure 1:
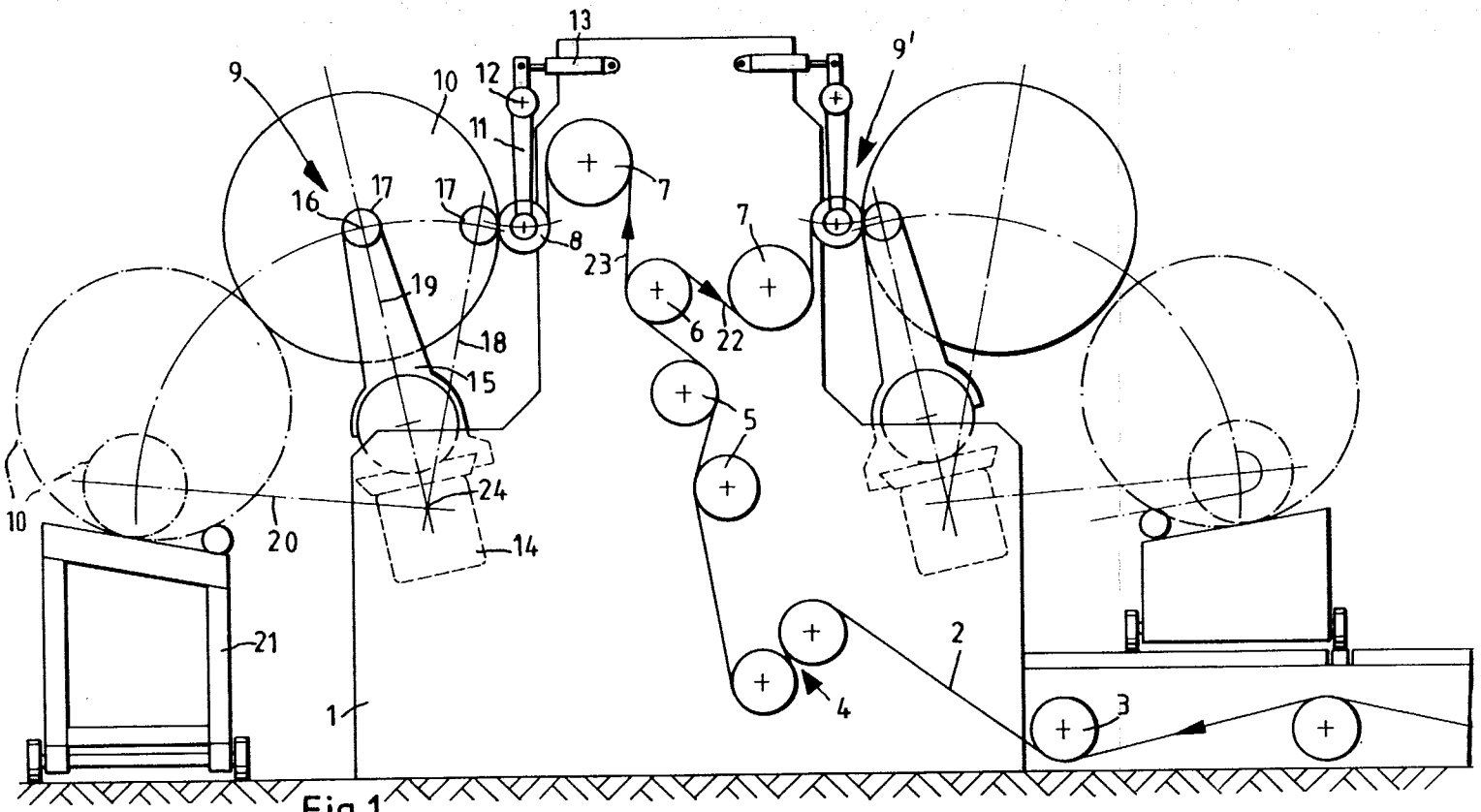
FIG. 1 is a largely diagrammatic side elevational view of the reel cutting and winding machine according to the invention.
Figure 2:
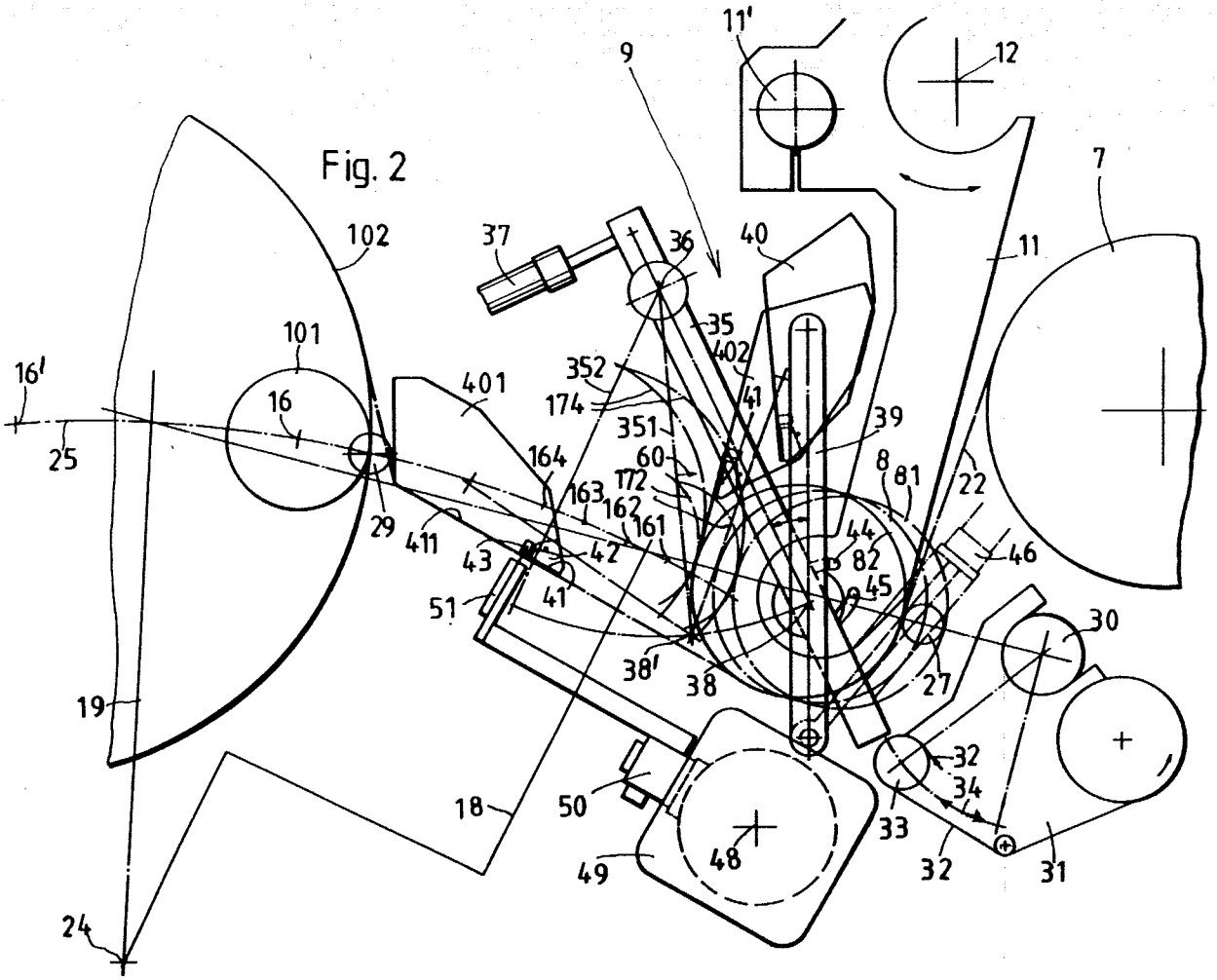
FIG. 2 is an enlarged side elevational view of the winding-up station on one side of the machine.

According to FIG. 1 the reel cutting and winding machine is constructed between two shield plates 1 which accommodate in particular the bearings for the deflecter rollers and the pivot levers. The sheet 2 comes from an unwinding device (not shown) or from some other delivery device and is guided under deflecter rollers 3 to a cutting unit 4 which cuts the sheet 2 into strips 22, 23. By means of further deflecter rollers 5 the strips 22, 23 are guided from a separating roller 6, to which adjacent strips 22 and 23 in each case are guided to form separate groups of wound packages assemblies 9 and 9' on different sides of the machine, as is known. Each group of wound package assemblies 9 and 9' comprise a deflector roller 7 and a pressure roller 8 which rests on the periphery of the wound package 10. The wound package assemblies 9 and 9' are formed such that they are substantially symmetrical with respect to one another. Each pressure roller 8 is mounted on a pair of swinging arms 11 so as to pivot about an axis 12. The two arms of a pair of swinging arms 11 are coupled to one another by means of a rod 11' (FIG. 2). A cylinder unit 13 supplies pressure force for the pressure roller 8.

Double levers 15 are guided on a pivotable cross-member 14, which extends over the entire width of the machine with each pair of levers having mounted thereon a pair of winding cores 17. All the winding cores 17 lie coaxially with respect to a common winding axis 16. The cross-member 14 is pivotable about a pivot axis 24 and can be pivoted into a winding position 18, a wound package sealing position 19 and a depositing position 20. These positions are not determined as angular positions of the double levers or of the diameter of the wound package but with respect to the periphery of the wound package, which will be explained in detail hereinafter. In the depositing position 20 a depositing table 21 is provided for the finished wound package 10 in each case. The wound packages assembly 9' on the other side of the machine is formed in a corresponding manner. The wound packages assemblies can also be arranged one above the other.

The wound packages assembly 9 on one side of the machine will be described in detail with reference to FIG. 2. FIG. 2 shows the pivot axis 24 of the cross-member 14, one double lever 15 only being illustrated diagrammatically by the position axes 18 and 19. The winding axis 16, which is determined by the double levers 15, moves on a circular path 25 when the double levers 15 and the cross-member 14 are pivoted. On the one hand the cross-member 14 is pivotable into a winding position 18. In dependence upon the diameter of the winding core and/or the increasing diameter of the wound package, the winding axis 16 can occupy different positions 161, 162, 163, 164. In the winding position 18 the pressure roller 8 abuts against the respective wound package and ensures that the wound package is formed accurately and uniformly. The pressure roller 8 cooperates with a light barrier 27, by means of which the pivoting of the cross-member 14 and the double levers 15 is controlled as the diameter of the wound package increases. A winding core 172 with a small diameter and a winding core 174 with a larger diameter are shown in the winding position. Of course, winding cores with any diameter within the structural limit values can be used.

The cylinder unit 13 provides a constant contact pressure for the pressure roller 8. As the diameter of the wound package increases the swinging arms 11 are pivoted in the anti-clockwise direction (FIG. 2) until the pressure roller 8 covers the light barrier 27. As a result of this, a pulse for pivoting the cross-member 14 with the double levers 15 in the anti-clockwise direction (FIG. 2) is generated in the machine control. The swinging arm 11 follow in the clockwise direction. Various positions of the pressure roller 8 within the operating area are indicated by the circles 81 and 82 with the circle 81 representing the position of the roller 8 covering the light barrier 27. In this way the wound package is formed in the known manner.

The double levers 15 can be pivoted into a wound package sealing position 19. In the wound package sealing position 19 various positions of the winding axis 16 and 16' are likewise shown in accordance with various diameters of the wound packages. The wound package sealing position 19 is determined by a further light barrier 29 in such a way that the peripheral arc of the finished wound package 101 or 102 intersects the circular path 25 in the region of the light barrier 29 in the same manner as described above with reference to light barrier 27.

A plurality of label dispensers 31, each containing a carrier strip 32 with adhesive labels, are positioned on a shaft 30 which is mounted between the shield plates 1 and extend over the entire width of the machine and are pivotable by means of a drive device (not shown). Each label dispenser 31 has a delivery roller 33 about which the label strip 32 is guided. When the shaft 30 rotates the label dispenser is pivoted in the direction of the double arrow 34. During pivoting in the clockwise direction the pressure roller 33 is pressed against the strips 22 running over the pressure roller 8 so that self-adhesive labels are transferred to the strips 22. The label dispensers 31 are pivoted in accordance with the machine control. In each case when the delivery roller 33 is pivoted towards the pressure roller 8 the advance of the carrier strip 32 is switched on. The advance drive and the winding-up process and the unwinding of the carrier strip 32 are not shown in detail. A label dispenser 31 of this type is known per se.

Figure 4:
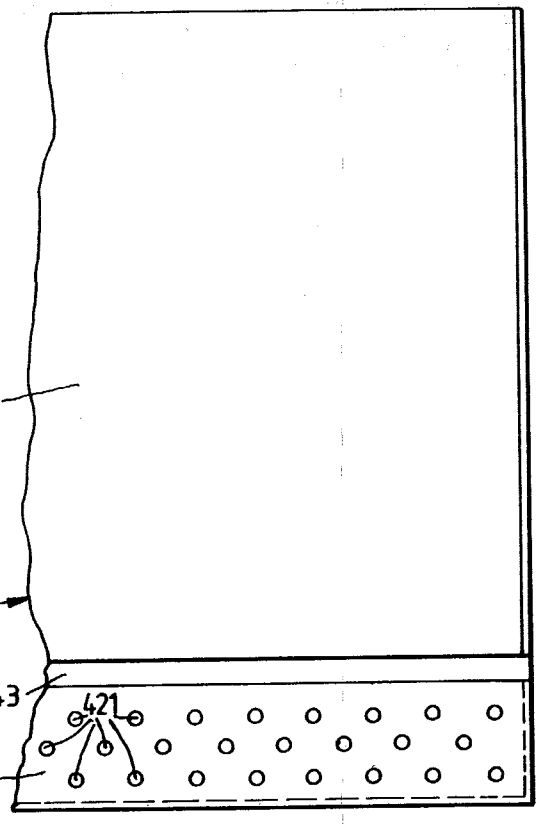
FIG. 4 is a side view elevational taken from the left of FIG. 3.
Figure 3:
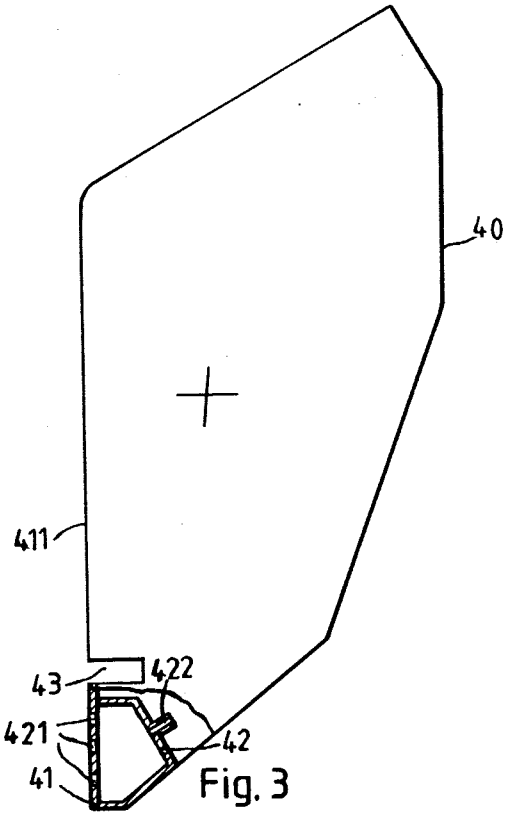
FIG. 3 is a vertical section sectional view through the vacuum table.

A carrier lever 35 is mounted in each shield plate 1 so as to pivot about an axis 36. The carrier levers 35 are adjusted by means of cylinder units 37. Each carrier lever 35 bears an adjusting lever 39 which is pivotable about an axis 38. The adjusting levers 39 bear in rigid alignment a vacuum table 40 which extends over the entire operating width of the machine, with the details of the table being shown in FIGS. 3 and 4. The vacuum table 40 has a holder plate 41, below which a vacuum chamber 42 is disposed. A plurality of suction nozzles 421 are provided in the holder plate 41. The suction chamber 42 is connected to a low-pressure source (not shown) by a suction nozzle 422. A cutting slot 43 and a guide plate 411 are adjacent the holder plate 41.

Each carrier lever 35 bears two stops 44 and 45 which restrict the movement of the respective adjusting lever 39. Each adjusting lever 39 is pivoted by means of a cylinder unit 46. The carrier levers 35 form a joining unit with the adjusting levers 39 and the vacuum table 40. The vacuum table 40 acts as a joining table and also as a cutting table. In addition, a pneumatic or mechanical application apparatus can be secured to the vacuum table 40 such that the strip beginning in each case can be applied smoothly onto a winding core.

The joining unit is aligned in such a way that the axis 36, about which the carrier lever 35 can pivot, is approximately between the pivot axis 12 of the swinging arm 11 and the winding axes-161 . . . 164 in the winding position 18 of the winding core 17.

The joining unit is shown in FIG. 2 in solid lines in the waiting position wherein the vacuum table 40 is above the pressure roller 8 and externally of the peripheral arc of the wound package. The vacuum table 40 is approximately between the pressure roller 8 and the axis 12 of the swinging arms 11. In this position the vacuum table cannot hinder the winding process.

The carrier levers 35 can be pivoted into an operating position 351, in which the axis 38' of the adjusting levers 39 is approximately externally of the peripheral arc of the pressure roller 8. In this operating position the vacuum table 40 can be pivoted into a transverse cutting position 401 and a joining position 402. In the joining position 402 the vacuum table abuts against the stop 44 and in the transverse cutting position 401 it abuts against the stop 45 of the carrier lever 35. The surfaces of the holder plate 41 and the guide plate 411 are aligned in each case tangentially to the pressure roller 8, the distance of the edge of the holder plate 41 along the tangent in the transverse cutting position being equal to the distance of the edge of the holder plate along the corresponding peripheral arc plus the tangent section in the joining position. In addition, the carrier levers 35 can be pivoted into a resetting position indicated by line 352. In this position the carrier levers 35 and the adjusting levers 39 free the path for an axial displacement of the swinging arms 11 when the machine has to be set to another wound package width or pressure units have to be driven into a parking position.

A cross-member 49, on which a transverse cutting apparatus 50 with a cutting blade 51 is displaceable, is pivotable on a shaft 48 mounted in the shield plates 1. In the cutting position shown in solid lines the cutting blade penetrates into the cutting slot 43 of the vacuum table 40 in the transverse cutting position. The cross-member 49 with the transverse cutting apparatus 50 is pivotable in the anti-clockwise direction through approximately 90° into a waiting position (not shown).

The functioning of the joining unit when the reels are exchanged will now be explained. It is to be assumed that a winding core 172 is wound. The joining unit is in the waiting position shown in solid lines, so that the pressure roller 8 rests in an unimpeded manner against the winding core 172 or the wound package when the wound package is being formed. As the diameter of the wound package increases the cross-member 14 is steered away under the effect of the light barrier 27. As soon as the desired strip length has been wound onto the wound package the reel exchange is initiated by a command to the machine control.

The machine speed is firstly reduced to a creep speed. Before the machine is stopped the shaft 30 is pivoted to a corresponding extent so that the label dispensers 31 are pivoted towards the pressure roller 8 and self-adhesive labels are transferred from the delivery rollers 33 onto the strips 22. Approximately simultaneously the cross-member 14 and the double levers 15 are pivoted into the wound package sealing position 19 illustrated, the peripheral arc of the finished wound package 10 being steered by the light barrier 29 in the manner shown. The machine comes to a halt. The carrier levers 35 are preferably pivoted into the operating position 351 overlapping with the pivoting of the cross-member 14. The adjusting levers 39 are subsequently pivoted in the clockwise direction about the axis 38' to the stops 45 so that the vacuum table 40 occupies the transverse cutting position 401. The course of the strip 22 is shown in dot-dash lines. The strip 22 lies on the holder plate 41 and the guide plate 411. The cross-member 49 is pivoted in the clockwise direction out of the waiting position into the illustrated transverse cutting position. The transverse cutting device 50 is set in operation and moved over the entire operating width of the machine so that all the strips 22 are severed in the transverse direction. The finished wound package 102 are rotated further by a small angular distance so that the strip end bearing the applied self-adhesive labels is connected by adhesion to the wound package and the wound package is thereby sealed.

Further self-adhesive labels are situated at the beginning of the strip which is retained by the vacuum chamber 42 on the holder plate 41. The carrier levers 35 remain in their position. The adjusting levers 39 are pivoted in the clockwise direction towards the stops 44 so that the vacuum table occupies the joining position 402. When the axis 38' occupies the illustrated position approximately externally of the peripheral arc of the pressure roller 8, the strip beginning is wound round in a substantially tension-free manner during this pivoting, since the tangential path of the strip beginning in the transverse cutting position 401 is equal to the winding-round path of the strip beginning in the joining position 402.

In the meantime, the cross-member 14 is moved into the depositing position 20 so that the finished wound packages can be deposited onto the depositing table 21. The double levers 15 are equipped with new winding cores. The cross-member 14 is pivoted back in the clockwise direction into the winding position. The pivoting occurs until the respective winding core 172 or 174 abuts against the pressure roller 8. The pivoting then continues further until the pressure roller 8 is urged back into the position 81. In this connection the empty winding core 172 or 174 strikes against the edge of the holder plate of the transverse cutting table, with the strip beginning bearing a self-adhesive label being connected by adhesion to the winding core. Thus the lever arrangement of the joining unit can yield since the carrier levers 35 are pivoted in the operating position 351 in the direction of arrow 60. The hydraulic cylinder unit 37 has a corresponding degree of flexibility. The strip beginning can additionally be joined completely and smoothly and applied onto the winding core by a mechanical or pneumatic application apparatus.

Thus the strip beginning is joined smoothly and uniformly to the winding core. The machine is now accelerated to its operating speed. Both the joining unit 47 and the cross-member 49 are pivoted back into the waiting position until a new wound package is formed.

The label dispenser 31 brings a sufficient number of adhesive labels onto the strip end and the strip beginning in order to ensure that the wound package is sealed and the strip beginning adheres to the winding core in a satisfactory manner.

We claim:

1. A reel cutting and winding machine for longitudinally cutting a sheet into strips and for winding up the strips into separate wound packages, comprising:

(a) stationary mounting plates at either side of said machine, (b) a cross-member pivotally mounted between said plates, said cross-member being pivotable into a winding position, a wound package sealing position, and a package depositing position, (c) winding core means on which said strips can be wound, (d) pivotably mounted swing arms carrying a pressure roller for engaging the periphery of the wound strip, (e) lever means operatively connected to said cross-member and carrying said winding core means, (f) carrier lever means pivotably mounted between said plates for movement between a waiting position during the winding process and a second, operating position, (g) adjusting lever means pivotably mounted on said carrier lever means, and means to pivot said adjusting level means independently of said carrier lever means between a first strip cutting position and a second strip joining position, (h) a vacuum table carried by said adjusting lever means, said carrier lever means and said adjusting lever means cooperating to pivot said vacuum table into a strip cutting position, said vacuum table holding by suction the strips while being cut and prior to mounting the leading end of said cut strip onto another winding core means, and (i) cutting means for cutting said strip when retained by said vacuum table.

2. A reel cutting and winding machine as claimed in claim 1, characterized in that on the entry side the vacuum table comprises a holder plate having a plurality of suction apertures and a transverse cutting slot adjacent thereto.

3. A reel cutting and winding machine as claimed in claim 1, characterized in that the axis of the carrier lever means is arranged approximately between the axis of the swing arm of the pressure roller and the axis of the winding core means in the winding position.

4. A reel cutting and winding machine as claimed in claim 3, characterized in that in the waiting position of the carrier lever means the pivot axis of the adjusting lever means is approximately covered by the axis of rotation of the pressure roller, and the vacuum table lies externally of the diameter of the wound package.

5. A reel cutting and winding machine as claimed in claim 4, characterized in that in the transverse cutting and joining positions, the pivot axis of the adjusting lever means lies externally of the peripheral face of said pressure roller, and wherein said vacuum table includes a holder plate, with the distance of the edge of the holder plate along the tangent in the transverse cutting position being equal to the distance of the edge of the holder plate along a corresponding peripheral arc plus the tangent section in the joining position.

6. A reel cutting and winding machine as claimed in claim 5 characterized in that the pivot path of the vacuum table between the joining position and the transverse cutting position is approximately 90°.

7. A reel cutting and winding machine as claimed in claim 5 characterized in that in the transverse cutting position the adjusting lever means are aligned approximately perpendicularly to the swing arms carrying the pressure roller, and in that a transverse cutting apparatus is pivotable towards the vacuum table.

8. A reel cutting and winding machine as claimed in claim 5 characterized in that in the joining position of the vacuum table, the adjusting lever means are aligned approximately parallel to said swing arms carrying said pressure roller, and in that the pivot arc of the lever means is approximately perpendicular to the adjusting lever means.

9. A reel cutting and winding machine as claimed in claim 8, characterized in that the support of the carrier lever means is resilient, and in that in the joining position the empty winding cores, after contacting the pressure roller, touch the edge of the holder plate of the vacuum table.

10. A reel cutting and winding machine as claimed in claim 1, characterized in that the vacuum table has a mechanical or pneumatic joining apparatus which acts in the joining position to apply the strip beginning onto the winding core.

11. A reel cutting and winding machine as claimed in claim 1, characterized in that a resetting position, in which said carrier lever means and the vacuum table are out of the resetting path of the pressure roller, is provided for the carrier lever means and the vacuum table.

12. A reel cutting and winding machine as claimed in claim 1, further including a label dispenser, and means for pivoting the same toward and away from the sheet strips passing over said pressure roller, said label dispenser including a delivery roller over which a label strip is guided, said delivery roller during labeling being pressed against the strips running over said pressure roller so that labels are transferred to said strips.

* * * * *